United States Patent [19]

Timmer

[11] 4,089,474

[45] May 16, 1978

[54] GARBAGE DISPOSAL DRAIN PROTECTOR

[76] Inventor: Dana W. Timmer, 865 Buena Vista Rd., Santa Barbara, Calif. 93108

[21] Appl. No.: 783,414

[22] Filed: Mar. 31, 1977

[51] Int. Cl.[2] ..... B02C 18/40

[52] U.S. Cl. ..... 241/46 B; 241/100.5; 241/257 G; 209/235

[58] Field of Search ..... 241/32.5, 46 R, 46 A, 241/46 B, 100.5, 257 G; 4/187 R, 189, 190, 197, 286, 288, 290, DIG. 4, DIG. 19; 209/233, 235, 352, 370, 374

[56] References Cited

U.S. PATENT DOCUMENTS

| | | | |
|---|---|---|---|
| 2,400,879 | 5/1946 | Hilliker | 241/46 B |
| 2,567,992 | 9/1951 | Coss et al. | 241/46 B |
| 2,947,486 | 8/1960 | Higer | 241/257 G |
| 3,161,360 | 12/1964 | Levine | 241/100.5 |
| 3,804,341 | 4/1974 | Guth | 241/46 A |

*Primary Examiner*—Granville Y. Custer, Jr.
*Attorney, Agent, or Firm*—Edward J. DaRin

[57] ABSTRACT

A garbage disposal drain protector adapted to be secured in a commercially available garbage disposal unit for preventing silverware or the like accidentally swept into the unit from being subjected to the disposal cutting blades. The protector device is pivotally mounted to the disposal wall to catch silverware and may be pivoted out of position by large objects voluntarily forced into the unit so that they may be disposed of readily with the device returning to its normal position.

15 Claims, 5 Drawing Figures

GARBAGE DISPOSAL DRAIN PROTECTOR

PRIOR ART AND SUMMARY OF THE INVENTION

This invention relates to a garbage disposal drain protector for use in garbage disposal units mounted in a sink.

Residence type garbage disposals are generally mounted in alignment with the sink drain and extend beneath the sink. Food particles and scraps and the like are generally washed down the drain into a disposal unit where it is cut up and flows out of the unit into the sewage system. In disposing of such waste materials, silverware and similar large objects are sometimes washed into the drain, or inadvertently knocked into the disposal unit. When valuable objects such as silverware are exposed to the cutting blades of the disposal, these articles may be damaged, lost and/or the garbage unit itself may be damaged. Heretofore various proposals for solving this problem have been put forth by prior art methods. These proposals range from complicated, expensive devices to fairly simple devices such as simple apertured drain plugs for the sink drain. Some of these solutions are found in U.S. Pat. Nos. 3,161,360; 3,033,368 and 3,804,341. However, there is still a need for a relatively simple, inexpensive solution to the problem of silverware entering the garbage disposal that does not require the attention of an operator or to be put into operation by an operator but yet is substantially reliable, if not foolproof.

The present invention provides an improved, relatively inexpensive, simple device capable of being used with present day garbage disposal units that is relatively foolproof in protecting objects such as silverware and the like from being exposed to the cutting blades of the disposal unit without interfering with the normal operation of the unit including permitting waste materials and liquids to flow freely into and through the unit. A garbage disposal unit equipped with a protective device of the type of the present invention also allows large objects to be voluntarily disposed of without the need of any special operations. The drain protector of the present invention can be readily mounted in a new garbage disposal unit as well as units presently in use with a minimum amount of expense, time and effort. When the improved protective device of the present invention is installed in a commercially available garbage unit, the disposal can be operated without fear of damage to silverware, hands, or the unit itself. The protective device of the present invention also functions as a barrier for preventing disposed of objects from being thrown out by the operation of the cutting blades through the disposal housing and back into the sink.

From a structural standpoint, the garbage disposal drain protector of the present invention is integrated into a conventional garbage disposal unit wherein the unit has a housing having an open end for receiving waste material to be disposed of and is provided with waste material cutting blades rotatably mounted within the housing a preselected distance from the open end. An improved protective device is pivotably secured to the side of the garbage disposal housing intermediate the open end of the housing and the cutting blades without interfering with the normal operation of the disposal. The protective device functions as a guard against large objects accidentally falling into the disposal by catching and holding them without being subjected to the cutting blades and yet be swingable out of the path of a large object that is manually and voluntarily placed into the garbage disposal unit to be disposed of.

These and other features of the present invention may be more fully appreciated when considered in the light of the following specification and drawings, in which.

Figure 1:
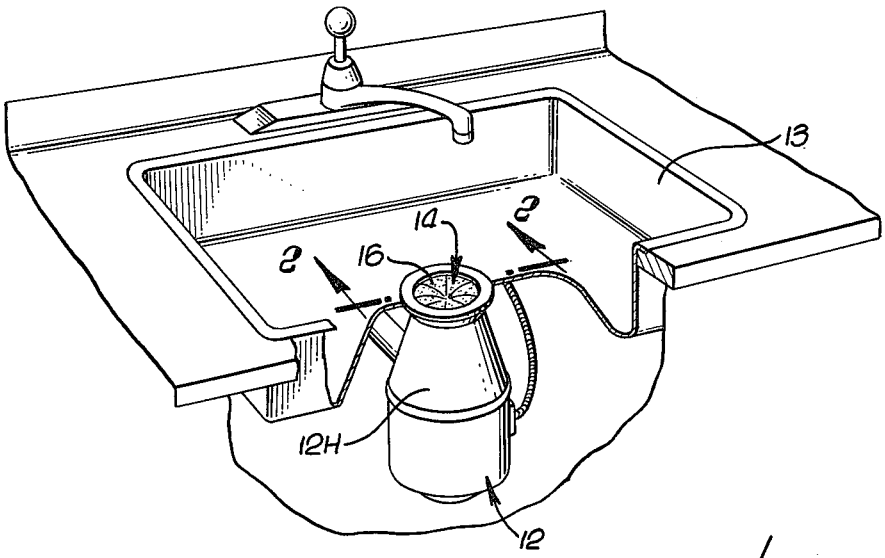
FIG. 1 is a perspective view, with portions broken away, of the garbage disposal unit mounted in a sink and embodying the present invention.
Figure 2:
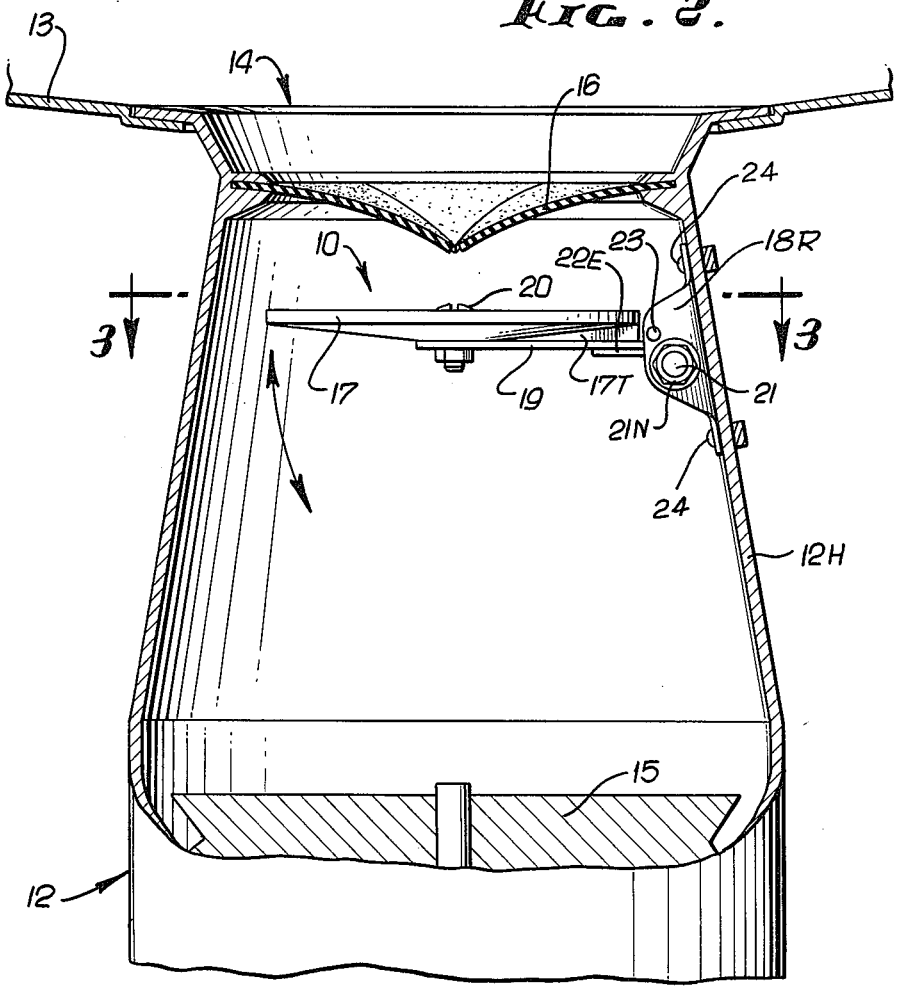
FIG. 2 is a cross-sectional view taken along the line 2'2 of FIG. 1.

Now referring to the drawings, the improved garbage disposal drain protector 10 will be described. A conventional, garbage disposal 12, as illustrated in FIG. 1, mounts beneath a sink 13 in alignment with a drain opening 14 for permitting food particles, scraps and small waste materials to be washed into the drain 14 and thereby into the disposal 12. A conventional garbage unit 12 is generally mounted with cutting blades 15 rotatably mounted in the garbage disposal unit 12 for cutting up waste particles washed in or placed into the unit; see FIG. 2. The garbage disposal unit 12 generally has a slotted rubber flange 16 secured to the open end of the housing 12H for the garbage disposal unit 12 so that it mounts just below the level of the drain 14 as best appreciated from examining FIG. 2. The garbage disposal drain protective device 10 is secured within the upper housing portion 12H for the unit 12 intermediate the open end thereof, or the end mounting the rubber flange 16, and the cutting blades 15 in a plane substantially parallel to the open end of the housing. The garbage disposal drain protective device 10 is mounted sufficiently close to the open end of the sink drain 14 to catch silverware and similar large objects that may pass through the rubber flange 16.

Figure 3:
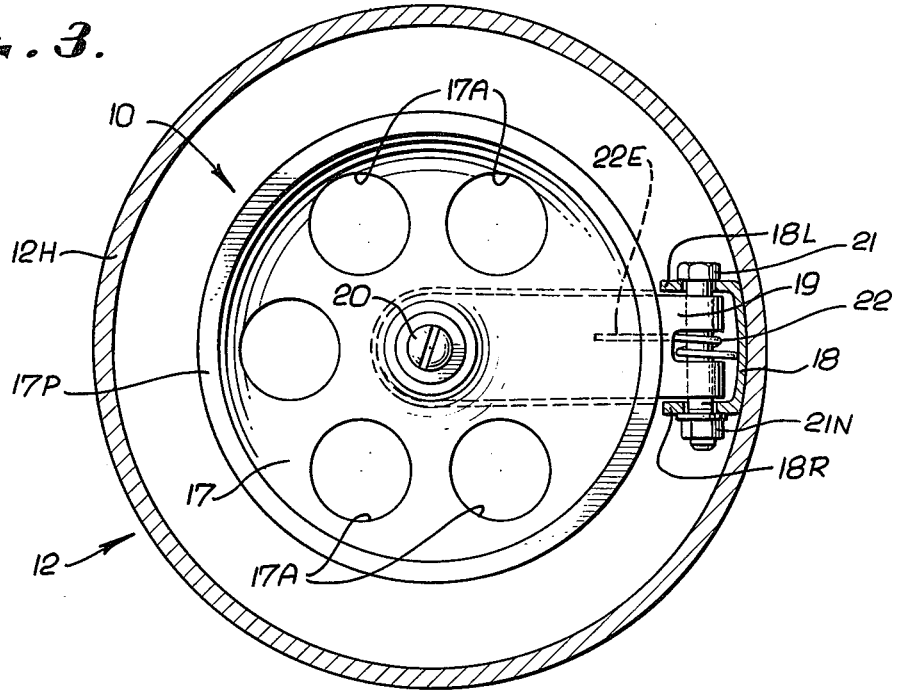
FIG. 3 is a sectional view taken along the line 3—3 of FIG. 2.
Figure 4:
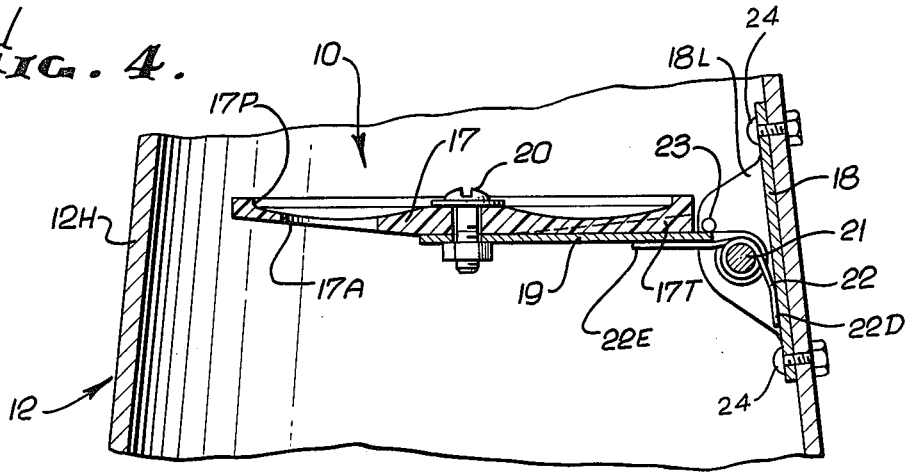
FIG. 4 is a partial, cross-sectional view through the drain protective device as illustrated in FIG. 4.

The garbage disposal drain protective device 10 comprises a dish-shaped or concave element 17 pivotable mounted to the side wall of the garbage disposal housing 12H by means of a bracket 18 secured thereto. The bracket 18 secures a mounting arm 19 extending outwardly of the bracket proper for securing the disc 17 adjacent its end and adjacent the central portion of the disc 17 by means of a fastener, such as the fastener 20 illustrated secured thereto. The disc 17 is preferably provided with a concave surface opening upwardly towards the open end of the housing 12 for catching the silverware or similar large objects that accidentally pass through the rubber flange 16. The inner end of the mounting arm 19 is bent into a circular-like configuration for defining a socket to receive a mounting shaft 21 rotatably secured between the arms 18L and 18R of the U-shaped bracket 18. The shaft 21 may conveniently be a bolt having a threaded end. As illustrated in FIG. 3, the bolt head is mounted at the bracket arm 18L with the threaded end secured to the bracket arm 18R with a nut 21N. The shaft 21 mounts a spring 22 which may be constructed of a relatively rigid wire for maintaining the arm 19 in a horizontal plane. The spring 22 has one of its free ends 22E extending outwardly from the shaft 21 in a plane parallel to the plane of the mounting arm 19 and extending underneath the arm longitudinally for a preselected distance. The other end of the spring 22 is arranged substantially perpendicular to the shaft 21 and extends downwardly therefrom and bent into engagement with the bracket 18 for maintaining the arm 19 in the desired horizontal plane. This end of the spring 22 is identified as the end 22D. This portion of the spring 22 tends to resist any pivotal movement of the mounting arm 19 and any objects held by the protective disc 17 secured thereto. The left-hand arm of the U-shaped bracket 18 or the arm 18L mounts a stop pin 23 extending in a substantially perpendicular relationship to the plane of the bracket arm 18L for the bracket 18 and into the interior of the "U" of the bracket. The stop pin 23 is located for arresting the upward swinging movement of the arm 19 once it has been pivoted from its normal horizontal position in a counterclockwise direction and released from its inner position in the housing 12H. Stated differently, the stop pin 23 arrests the clockwise movement of the arm 19 after the disc 17 has been released for positioning and maintaining it in the desired horizontal plane.

Figure 5:
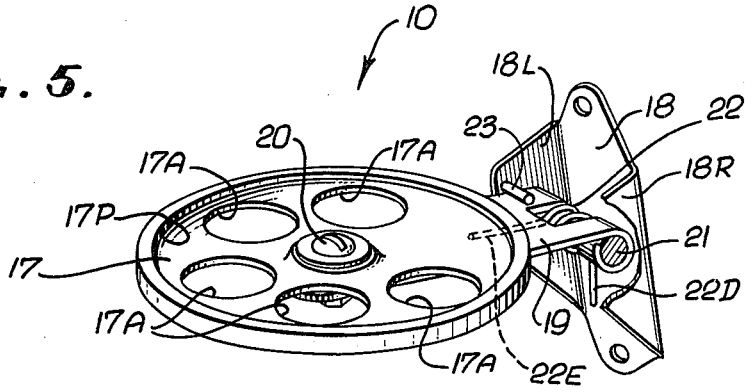
FIG. 5 is a perspective view, with a protion broken away, of the detached garbage disposal drain protective device.

The configuration of the disc 17 is selected so that the portion thereof overlying the mounting arm 19 has an increased thickness so as to completely overlie the entire width of the mounting arm 19 without any space therebetween. This portion of the disc 10 is further identified by the reference numeral 17T. The disc 17 can be further secured to the mounting arm 19 by means of an additional fastener (not shown) adjacent the inner peripheral edge of the disc 10, if required. The protective disc 17 further includes a multiplicity of spaced apart liquid drainage apertures 17A arranged therein. Five such drainage apertures 17A having a preselected diameter are illustrated in FIGS. 3 and 5 for this purpose. The drainage apertures 17A permit liquids and small waste material to drain through the disc 17. The disc 17 is also provided with an upstanding peripheral lip 17P, as best seen in FIG. 5.

The diameter of the disc 17 is selected so that it is spaced from the interior walls of the housing 12H to permit the normal operation of the garbage disposal unit 12 whereby the waste material may be washed into the drain 14 from the sink 13 into the unit 12 around the protective device 10 so as to reach the cutting blades 15. The diameter of the disc 17 should be approximately the same as the inside diameter of the open end of the housing 12H. In one practical embodiment, the diameter of the disc may be on the order of 2½ inches and be mounted approximately 1 to 2 inches below the level of the sink 13. The disc 17 is preferably constructed of a relatively soft, pliable material that is sufficiently stiff to trap utensils and similar large objects passing through the flange 16. The disc 17 may be constructed of an elastomeric material including a synthetic elastomeric material or rubber for this purpose. If necessary, wires may be embedded into the disc 17 for stiffening purposes. In spacing the protective device 10 within the housing 12H, the relationship of the final inner location of the device 10 with respect to the cutting blades 15 must be taken under consideration. The device 10 must not only be spaced sufficiently close to the open end of the housing 12H for arresting the movement of large objects entering the disposal 12 but it also must be spaced a sufficient distance from the cutting blades 15 for permitting substantial pivotal counterclockwise movement of the device without striking the cutting blades 15 so as to prevent any damage to the device 10 or damage to the cutting blades 15 during operation of the disposal unit 12.

A conventional garbage disposal unit is readily separable so that the housing portion 12H may be readily removed from the bottom section of the housing and thereby allow access to the interior of the portion 12H. This allows the protective device 10 of the present invention to be readily secured to the housing section 12H. For this purpose the bracket 18 may be secured to the interior wall of the housing 12H very readily by means of fasteners 24 which are preferably secured through holes drilled in the wall of housing 12H to facilitate securing the bracket 18 thereto. With this completed, the two portions of the disposal housing may be secured together in their normal relationship, as illustrated in FIG. 1, for permitting the disposal 12 to be used for its intended purposes.

With the above structure in mind the operation of the protective device 10 can be readily understood. The garbage disposal unit 12 will operate in its normal fashion for the usual size waste material disposed of in a residential type unit. In this arrangement the food or scraps will travel around the protective device 10 and pass through the space provided between the interior wall of the housing wall 12H and the outer edges of the protective device 10 so as to travel to the cutting blades 15. Small objects may pass through the disc apertures 17A. Those objects that do not pass through the apertures 17A may be washed over the edge of the disc 17. In the event silverware does pass through the open end of the housing 12H, it will be trapped or caught by the protective device 10 and may be readily retrieved by hand from the device. In the event there is a large object to be voluntarily disposed of, it is necessary to dispose of this object manually in view of the location of the protective device 10. For this purpose, the large object may be forced against the disc 17 so as to cause it to pivot in a counterclockwise direction out of the path of the object so that the object may travel to the cutting blades 15. After the large object has passed beyond the location of the protective device 10, the device will automatically return it to its normal horizontal, protective position in the housing 12H due to the urging of the spring 22. Specifically, the device 10 will pivot clockwise until its swinging movement is arrested as a result of the arm 19 engaging the stop pin 23.

It should now be appreciated that the improved protective device 10 will function to capture any large objects such as silverware or the like that may inadvertently pass into the disposal 12 and that the protective operation is automatic. No attention to or positioning of the device 10 is necessary, once installed in the disposal 12, for affecting the desired function and can be considered to be relatively foolproof and having an indeterminate life. It should now be appreciated that the protective device 10 may be readily integrated into a conventional garbage disposal unit including the units presently installed in use with a minimum amount of time, effort or skill.

What is claimed is:

1. A garbage disposal unit comprising a garbage disposal housing having an open end for receiving waste material to be disposed of by means of the disposal and waste material cutting blades rotatably mounted within the housing a preselected distance inwardly of the disposal open end, and a protective device pivotable secured to the housing intermediate the open end of the housing and the cutting blades, the protective device being normally mounted in a plane substantially parallel to the plane of the disposal open end and extending adjacent the side walls of the housing and yet spaced therefrom to permit waste material to move through the space between the housing and the edge of the protective device, the protective device normally functioning as a guard to trap utensils and similar large objects falling thereon from inadvertently moving through the disposal to the cutting blades and yet being manually pivotable out of the path of a large object that it is desired to dispose of in response to the manual entry of a large object into the open end of the housing and moved against the protective device and pivoted out of its normal position to allow the object to be moved beyond the protective device to the cutting blades and automatically pivots to its normal position after it has been released.

2. A garbage disposal unit as defined in claim 1 wherein the protective device is provided with a concave curvature and with the concavity mounted facing the open end of the garbage disposal.

3. A garbage disposal unit as defined in claim 1 wherein the protective device is provided with a multiplicity of spaced apart apertures to permit liquids to flow therethrough.

4. A garbage disposal unit as defined in claim 1 wherein the protective device is constructed of a relatively soft, pliable material and yet sufficiently stiff to trap utensils and similar large objects falling thereon for preventing them from moving beyond the device to the cutting blades.

5. A garbage disposal unit as defined in claim 1 wherein the protective device is spaced adjacent the open end of the housing sufficiently close for trapping the large objects and spaced a distance from the cutting blades for permitting substantial pivotable movement of the device towards the cutting blades without striking the cutting blades, thereby permitting large objects to be voluntarily disposed of.

6. A garbage disposal unit as defined in claim 5 wherein the protective device has a plurality of spaced apertures extending therethrough and a dish-like, circular shape opening towards the open end of the housing.

7. A garbage disposal unit as defined in claim 6 including means for yieldably maintaining the protective device in a plane substantially parallel to the plane of the open end of the housing.

8. A garbage disposal unit as defined in claim 6 including bracket means for pivotably mounting the protective device to the housing and securing it thereto.

9. A garbage disposal unit so defined in claim 8 wherein the protective device includes an upstanding lip defined adjacent to the peripheral edge thereof, and wherein said bracket means is constructed and defined for permitting the protective device to be pivoted towards the cutting blades of the disposal and includes means for arresting the return movement of the protective device towards the disposal open end to arrest it in its normal position.

10. A protective device for a garbage disposal and adapted to be mounted within the disposal housing, said protective device comprising a dish-shaped element, said element is constructed of a relatively soft, pliable material and yet is sufficiently stiff to trap utensils and the like, means for pivotably mounting the dish-shaped element to a disposal housing wall with said element being spaced from the inner walls of the housing, said mounting means comprises a mounting arm extending outwardly thereof and securing said dish-shaped element adjacent the outer end thereof, means for resiliently securing said arm to said mounting means to maintain the element in a plane substantially parallel to the disposal opening and being pivotally manually movable in a downward direction out of the said plane and automatically returned back to said plane.

11. A protective device for a garbage disposal as defined in claim 10 wherein said element is provided with a plurality of spaced apart liquid drainage apertures extending therethrough for permitting liquids and relatively small objects to drain therethrough.

12. A protective device for a garbage disposal as defined in claim 11 wherein said element includes an upstanding lip defined adjacent to the peripheral edge thereof and extending completely around same.

13. A protective device for a garbage disposal as defined in claim 11 wherein said material is an elastomeric material.

14. A protective device for a garbage disposal as defined in claim 13 wherein said material is rubber.

15. A protective device for a garbage disposal as defined in claim 10 wherein said mounting means includes means for arresting the return movement of said dish-shaped element to said parallel plane.

* * * * *